US011406225B2

(12) United States Patent
Pollacco

(10) Patent No.: US 11,406,225 B2
(45) Date of Patent: Aug. 9, 2022

(54) APPARATUS FOR CONVERTING A BATHTUB INTO A SOAKER

(71) Applicant: Michael Pollacco, New York, NY (US)

(72) Inventor: Michael Pollacco, New York, NY (US)

( * ) Notice: Subject to any disclaimer, the term of this patent is extended or adjusted under 35 U.S.C. 154(b) by 78 days.

(21) Appl. No.: 16/523,132

(22) Filed: Jul. 26, 2019

(65) Prior Publication Data

US 2021/0022563 A1 Jan. 28, 2021

(51) Int. Cl.
*A47K 3/00* (2006.01)
*A47K 3/022* (2006.01)

(52) U.S. Cl.
CPC ..... *A47K 3/001* (2013.01); *A47K 3/022* (2013.01)

(58) Field of Classification Search
CPC ..... A47K 3/001
USPC ..... 4/538, 488, 191, 696, 619; 52/27, 34
See application file for complete search history.

(56) References Cited

U.S. PATENT DOCUMENTS 873,352 A * 12/1907 Diehl ..... G01B 3/30 33/562
1,159,395 A * 11/1915 Kohler ..... B22C 7/00 164/249
2,853,714 A * 9/1958 Darmstadt ..... A47K 3/001 4/580
3,389,474 A * 6/1968 Linn ..... B27M 3/0093 33/479
3,614,793 A * 10/1971 Nemiroff ..... A47K 3/001 4/580
4,043,853 A * 8/1977 Saladino ..... B29C 63/22 156/94
4,158,585 A * 6/1979 Wright ..... A47K 3/001 156/94
4,750,967 A * 6/1988 Kott ..... B29C 51/162 156/499
5,200,257 A * 4/1993 Gatarz ..... B29C 33/0044 4/585
5,435,021 A * 7/1995 Williams ..... A47K 3/281 4/580
5,560,092 A * 10/1996 Roiger ..... A47K 3/04 156/94
5,911,943 A * 6/1999 Minghetti ..... B29C 51/12 264/516
6,088,847 A * 7/2000 Burrow ..... A47K 3/122 297/344.24
6,101,642 A * 8/2000 Auten ..... A47K 3/002 4/546

(Continued)

*Primary Examiner* — Lori L Baker
(74) *Attorney, Agent, or Firm* — Patent Ventures, LLC

(57) ABSTRACT

An apparatus comprises a rectangular fitting dimensionally conformed to a perimeter of a bathtub wall. The rectangular fitting includes a first portion and a middle portion. The first portion comprises a water-impermeable material coated with an adhesive material along the length of a bottom surface. The first portion includes a top surface conjoined with the middle portion. The adhesive-coated bottom surface of the first portion securely adheres to a top surface of the bathtub wall in order to be dimensionally conformed to the perimeter of the bathtub wall. The middle portion is configured to extend upward and downward to pre-determined heights by a user while the first portion securely adheres to the bathtub wall. The apparatus is configured to store water above the top edge of the bathtub wall, thereby converting the bathtub into the soaker.

18 Claims, 11 Drawing Sheets

(56) References Cited

U.S. PATENT DOCUMENTS

| | | | | |
|---|---|---|---|---|
| 6,996,860 | B1 * | 2/2006 | Blake | A47K 3/001 4/498 |
| 8,973,177 | B2 * | 3/2015 | Bates | A47K 3/003 4/584 |
| 9,131,809 | B2 * | 9/2015 | Stafford | A47K 3/006 |
| 9,375,115 | B2 * | 6/2016 | Stafford | A47K 3/003 |
| 9,877,615 | B2 * | 1/2018 | Ahmes | A47K 3/02 |
| 2002/0023363 | A1 * | 2/2002 | Woerlein | A47K 3/02 33/562 |
| 2003/0147241 | A1 * | 8/2003 | Hildebrand | F21V 33/004 362/231 |
| 2006/0015998 | A1 * | 1/2006 | Whitinger | F24H 1/0081 4/545 |
| 2008/0222788 | A1 * | 9/2008 | Cunningham | A47K 3/02 4/538 |
| 2012/0005820 | A1 * | 1/2012 | Stafford | A47K 3/006 4/555 |

* cited by examiner

APPARATUS FOR CONVERTING A BATHTUB INTO A SOAKER

BACKGROUND OF THE INVENTION

A. Technical Field

The present invention generally relates to a bathtub, and more specifically relates to an apparatus for converting a bathtub into a soaker or a customized bathing tub with a height-adjustable feature to store and increase the water level to a plurality of pre-defined heights.

B. Description of Related Art

A bathtub, bath, or tub (informal) is a large or small container for holding water in which a person or animal may bathe. Most modern bathtubs are made of thermoformed acrylic, porcelain enameled steel, fiberglass-reinforced polyester, or porcelain enameled cast iron. A bathtub is usually placed in a bathroom either as a stand-alone fixture or in conjunction with a shower. Modern bathtubs have overflow and waste drains and may have taps mounted on them. They are usually built-in but may be free-standing or sometimes sunken. Until recently, most bathtubs were roughly rectangular shape, but with the advent of acrylic thermoformed baths, more shapes are becoming available. Bathtubs are commonly white color, although many other colors can be found.

However, the bathtubs are smaller for bathing adults. The traditional bathtubs are generally shorter than the adult height, it is often the bathers must sit or knee bent, upper body leaning or lying on a bath back. Further, the traditional bathtubs are usually very shallow pool so the body of the bathers could be exposed above the water, of course, bathers could adjust the posture of the body so that it is partially immersed or immersed in water, but the legs and/or side will be exposed.

Therefore, there is a need for an apparatus used to simply convert the conventional or traditional bathtubs into a soaking tub or a soaker to hold water deeper for relaxation for the user. There is a need for an apparatus for making a customized bathing tub with a height-adjustable feature for increasing water level to a plurality of pre-defined heights based on the requirement of the user. Further, there is also a need to provide an apparatus to increase water level within the traditional or conventional bathtubs to a plurality of pre-defined heights based on the requirement of the user.

SUMMARY OF THE INVENTION

The present invention relates to an apparatus for converting a bathtub into a soaker. In one embodiment, the rectangular fitting or apparatus is configured to convert a traditional or conventional bathtub or tub into a soaking tub or a soaker. The apparatus is further configured to enable a user to customize the bathtub to increase the water level to a plurality of pre-determined heights. In one embodiment, the rectangular fitting or apparatus is further configured to store or house water in the bathtub to a level above the top edge of the wall of the bathtub, thereby converting the bathtub into a soaking tub or a soaker.

In one embodiment, the apparatus includes a front piece or a first fitting and a second fitting. In one embodiment, the first fitting piece is configured to securely adhered to a front top wall of the tub. In one embodiment, the front piece comprises a first portion, a pair of corner fittings, a handle, a pair of locks, and a middle portion or a second portion. In one embodiment, the middle portion of the first fitting/front piece is configured to extend upward and downward to a plurality of pre-determined heights by a user. In some embodiments, the middle portion is configured to extend upward and downward to a pre-determined height and/or to any user-preferred height by the user. In one embodiment, the handle is securely affixed to the middle portion of the front piece. The handle is configured to enable the user to lift upward and downward the middle portion of the front piece to a plurality of pre-defined heights. In one embodiment, the pair of locks is flexibly affixed to the pair of rectangular fittings. The pair of locks are configured to enable the user to lock the middle portion of the front piece at the desired heights.

In one embodiment, the front piece is securely adhered to the front top wall of the tub using an adhesive strip and a bracket. In one embodiment, the adhesive strip securely holds the front piece to the front top wall of the tub via the bracket. In one embodiment, the adhesive is at least one of, but not limited to, a rubber and a vinyl adhesive. In one embodiment, the first portion of the front piece is non-pliable base and composed of at least one of a material, but not limited to, a polyvinyl, a polyethylene, styrene, a polycarbonate, an acetal, an acrylic, and a polypropylene material. In one embodiment, the middle portion of the front piece is pliable and composed of at least any one of a material, but not limited to, a polypropylene, a polyethylene, a flexible plastic sheet, a vinyl, and a rubber.

In one embodiment, the middle portion of the front piece securely affixed to a front top wall of the tub using a pair of locks and a pair of corner fittings. In one embodiment, the front piece is dimensionally conformed to a perimeter of the front wall of the bathtub. In one embodiment, the front piece of the first portion comprised of any one of a water-impermeable material, which is coated with an adhesive material at any point along the length of a bottom surface of the front piece of the first portion. The adhesive-coated bottom surface of the front piece of the first portion securely adheres to a top surface of the wall of the bathtub to be dimensionally conformed to the perimeter of the bathtub's wall. In one embodiment, the front piece of the first portion comprises a top surface, which is conjoined with the middle portion. In one embodiment, the middle portion comprised of a water-impermeable material. The middle portion is configured to extend up or down to a plurality of pre-determined heights. The user could lift upward at one of the middle portion or second portion while the front piece of the first portion securely adheres to the top surface of the wall of the bathtub. In one embodiment, the user could easily egress from the bathtub by lowering and pushing the middle portion of the front piece or first fitting.

In one embodiment, the first fitting is securely affixed to the second fitting using a latch. In one embodiment, the second fitting is comprised of three-panels, which are affixed to form a U-shaped arrangement. In one embodiment, the second fitting is conformed to both sides and a back-top edge of the wall of the bathtub. In one embodiment, the second fitting is adhered to the top edge of the two sides and back wall of the bathtub.

In one embodiment, the rectangular fitting includes a middle portion of the first fitting/front piece, the first portion of the front piece, and a second fitting or 3-piece back panel. In one embodiment, the rectangular fitting is securely affixed over the top edge of the wall of the bathtub via a bracket. In one embodiment, the bracket securely adheres to the top edge of the wall of the bathtub. In one embodiment, the rectangular fitting could be securely adhered to the top edge of the wall of the bathtub using the bracket to store water to a particular height or above the bathtub's wall, thereby converting the bathtub into a soaking tub or a soaker.

In another embodiment, the rectangular fitting is made as a single piece or unit. In one embodiment, the fitting is dynamically conformed to a wall perimeter of the bathtub. In one embodiment, the fitting is dynamically conformed to a first or front top edge of the bathtub's wall. In one embodiment, the fitting comprises a first portion, a bracket, and a middle portion or a second portion. In one embodiment, the first portion acts as a base for the rectangular fitting. In one embodiment, the first portion is a non-pliable or non-flexible base. The first portion is composed of at least one of a material include, but not limited to, a polyvinyl, a polyethylene, styrene, a polycarbonate, an acetal, an acrylic, and a polypropylene material. In one embodiment, the middle portion of the rectangular fitting comprised of any one of a water-impermeable material. In one embodiment, the first portion is coated with an adhesive material at any point along the length of a bottom surface of the first portion. The adhesive coated bottom surface of the first portion dimensionally adheres to the first or the front top edge of the bathtub's wall. In one embodiment, the adhesive is at least one of, but not limited to, rubber and/or a vinyl adhesive.

In one embodiment, the first portion has a top surface, which is conjoined with the middle portion of the fitting. The middle portion is configured to be extended up and retracted down from the top surface of the bathtub's wall to a pre-determined height, based on the user requirement. In one embodiment, the middle portion of the fitting is in the form of, but not limited to, an accordion-pleated structure. The middle portion of the fitting comprises a plurality of wrinkles or folds, which enables the rectangular fitting to extend upwards and retract downwards to a plurality of pre-determined heights, based on the user requirement. In one embodiment, the user could lift the middle portions of rectangular fitting for extending upward to a pre-defined height. In some embodiments, the user could lift the middle portions of the fitting for extending upward to a plurality of pre-defined heights. In one embodiment, the user could lift any one of the middle portion of the fitting to any user-preferred height.

In one embodiment, the user could lift the middle portion of the fitting by extending upwards or retracting downwards, while the first portion securely adheres to the top edge of the bathtub's wall in order to house water in the bathtub to a level above the top edge of the bathtub wall, thereby converting the bathtub into the soaking tub or the soaker. In one embodiment, the user could easily egress from the bathtub by lowering the middle portion of the fitting. In some embodiments, the user could easily egress from the bathtub by lifting upwards the middle portion of the fitting from the first portion and/or removing the middle portion of the fitting. In one embodiment, the middle portion of the fitting is a pliable or flexible portion. The middle portion of the fitting could be composed of at least any one of a material include, but not limited to, a polypropylene, a polyethylene, a flexible plastic sheet, a vinyl, and a rubber.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The embodiments herein will be better understood from the following detailed description with reference to the drawings, in which.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1A:
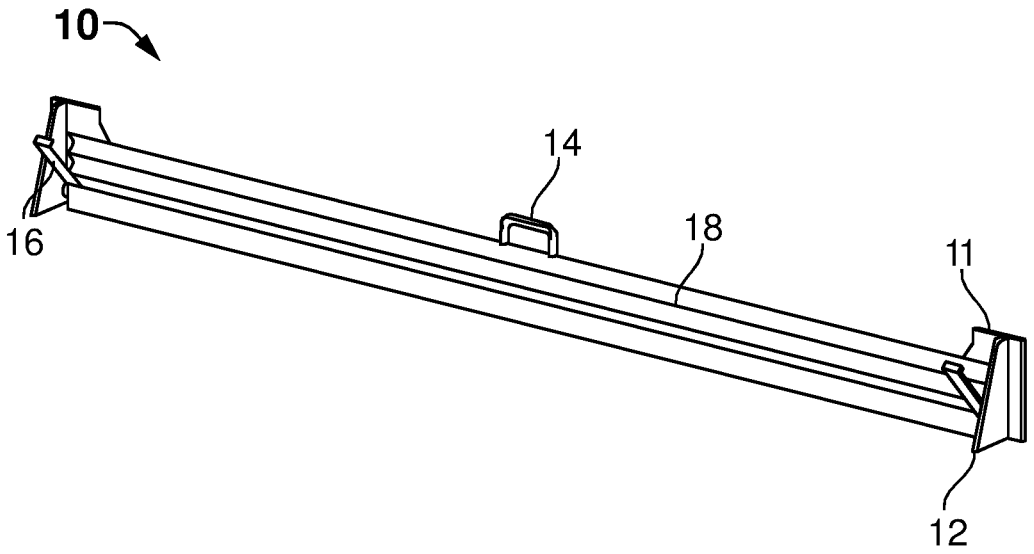
FIG. 1A exemplarily illustrates a front piece of an apparatus used to convert a bathtub into a soaker according to one or more aspect of the present invention.

The present invention discloses an apparatus or rectangular fitting (shown in FIG. 5) configured to convert a traditional or conventional bathtub or tub 19 (shown in FIG. 1B) into a soaking tub or a soaker. The soaker may be defined as a tub with a depth allowing for a user to soak or submerge without displacing water over the tub edge. In a standard bathtub, soaking or submerging usually results in the displacement of water due to the lack of depth. The present invention is an apparatus to house water above a top edge of a bathtub wall, comprising a water-impermeable fitting adhered to a top-surface of at least one bathtub wall with a water-proof seal. The water-impermeable fitting adhered with a water-proof seal over the top surface of any of the bathtub walls results in allowing a user to fill the bathtub with water above a top edge of the bathtub wall without leaking or displacing water, effectively converting a standard bathtub into a soaker. In some embodiments, the fitting—or at least a portion of the fitting—may be lowered or extended up. In other embodiments, the fitting—or at least a portion of the fitting—may be removable. In yet other embodiments, the fitting is fixed—immovable or unremovable. The apparatus is further configured to enable a user to customize the bathtub 19 to store and increase the water level to a plurality of pre-determined heights. Referring to FIG. 1A, a front piece or a first fitting 10 of the rectangular fitting or apparatus is disclosed. In one embodiment, the front piece 10 is configured to securely adhere to a front top wall of the bathtub 19. In one embodiment, the front piece 10 comprises a first portion 11, a pair of corner fittings 12, a handle 14, a pair of locks 16, an adhesive 43, and a middle portion or a second portion 18. In one embodiment, the middle portion 18 of the first fitting 10 is configured to extend upward and downward to a plurality of pre-determined heights by a user. In some embodiments, the middle portion 18 is configured to extend upward and downward, but not limited to, a pre-determined height and/or to any user-preferred heights by the user. In one embodiment, the handle 14 is securely affixed to the middle portion 18 of the front piece 10. The handle 14 is configured to enable the user to lift upward and downward the middle portion 18 of the front piece 10 to a plurality of pre-defined heights. In one embodiment, the pair of locks 16 are flexibly affixed to the pair of corner fittings 12. The pair of locks 16 are configured to enable the user to lock the middle portion 18 of the front piece 10 at the desired heights. In some embodiments, the fitting may be of any number of shapes that conform to any number of bath tubs. In a preferred embodiment, the fitting is rectangular to conform to a standard conventional bathtub. However, square, elliptical, or circular tubs, while unconventional, are known to exist as high-end bathroom fixtures. Additionally, the bottom portion of the fitting may be coated or lined with an adhering material, other than an adhesive, in order to adhere or affix to the top surface of any of the the bathtub walls. The key determinant for an optimal adhering material is that it must prevent any water leakage over the top edge of the bathtub wall.

Figure 1B:
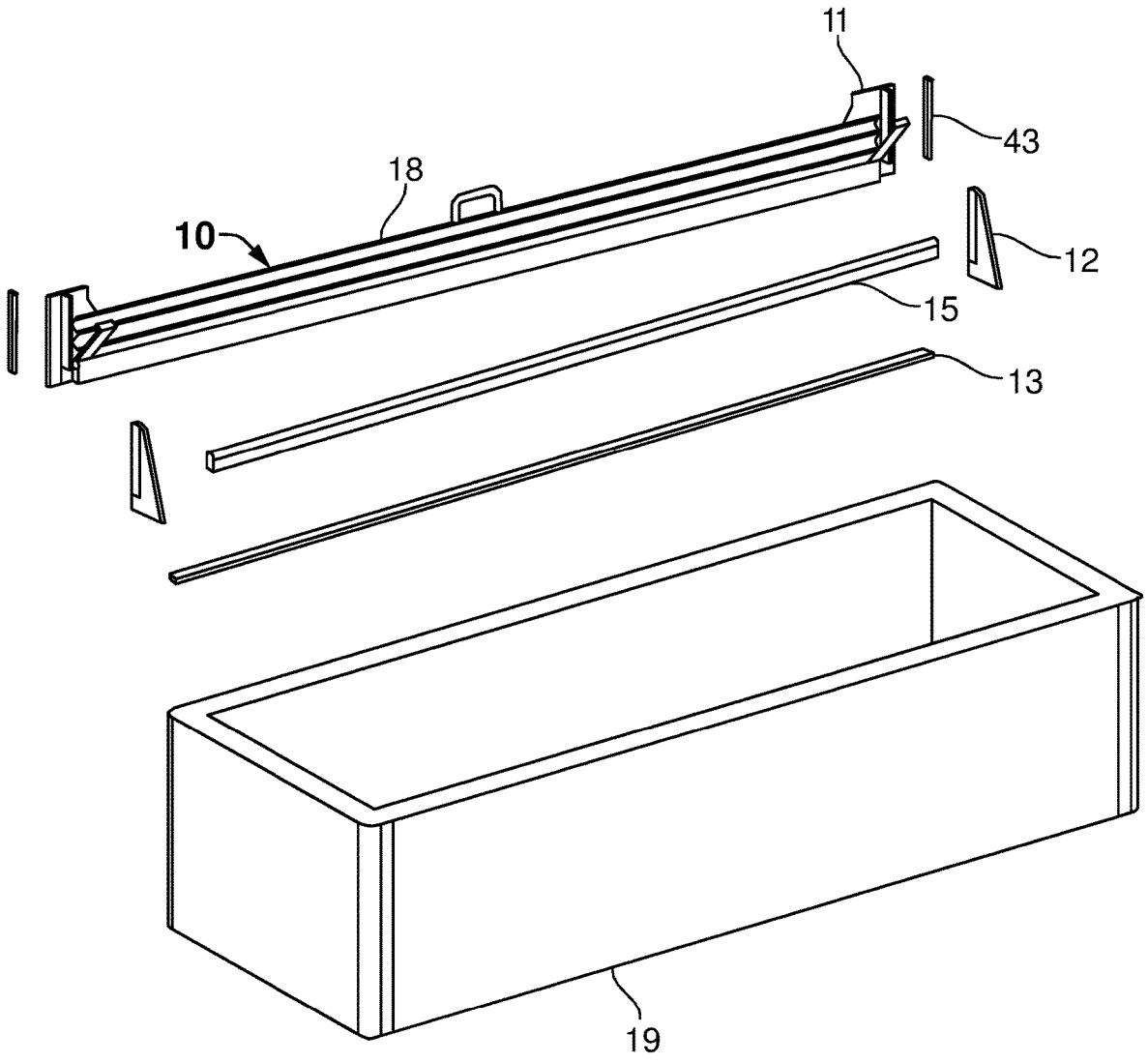
FIG. 1B exemplarily illustrates an assembly of the front piece of the apparatus secured on a top edge of the front wall of the bathtub using a bracket, according to one or more aspect of the present invention.

Referring to FIG. 1B, an assembly of the front piece 10 of the rectangular fitting or apparatus secured on a top edge of the front wall of the bathtub 19 is disclosed. In one embodiment, the front piece 10 is securely adhered to the front top wall of the bathtub 19 using an adhesive strip 13 and a bracket 15. In one embodiment, the adhesive strip 13 securely holds the front piece 10 to the front top wall of the bathtub 19 via the bracket 15. In one embodiment, the adhesive is at least any one of, but not limited to, a rubber and a vinyl adhesive. In one embodiment, the first portion 11 of the front piece 10 is non-pliable base and composed of at least any one of a material, but not limited to, a polyvinyl, a polyethylene, styrene, a polycarbonate, an acetal, an acrylic, and a polypropylene material. In one embodiment, the middle portion 18 of the front piece 10 is pliable and composed of at least any one of a material, but not limited to, a polypropylene, a polyethylene, a flexible plastic sheet, a vinyl, and a rubber.

Figure 2:
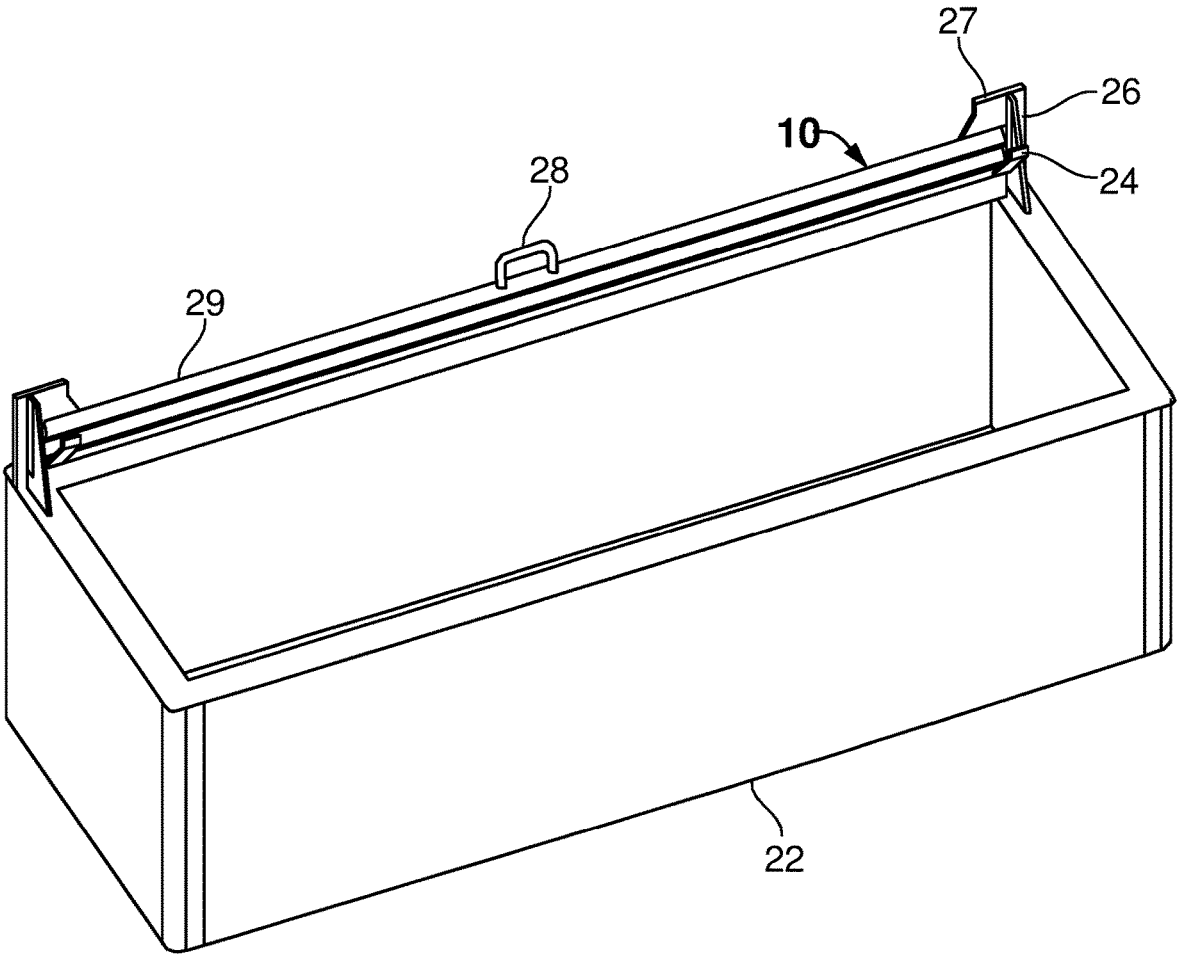
FIG. 2 exemplarily illustrates the front piece of the apparatus adhesively secured on the top edge of the front wall of the bathtub, according to one or more aspect of the present invention.

Referring to FIG. 2, the middle portion 29 of the rectangular fitting or apparatus securely affixed on the top edge of the front wall of the bathtub 22 is disclosed. In one embodiment, the middle portion 29 of the front piece 10 is securely affixed to a front top wall of the bathtub 22 using a pair of corner fittings 26. In one embodiment, the front piece 10 is dimensionally conformed to a perimeter of the front wall of the bathtub 22. In one embodiment, the first portion 27 of the front piece 10 is comprised of any one of a water-impermeable material, which is coated with an adhesive material at any point along the length of a bottom surface of the first portion 27 of the front piece 10. The adhesive-coated bottom surface of the first portion 27 of the front piece 10 securely adheres to a top surface of the wall of the bathtub 22 to be dimensionally conformed to the perimeter of the bathtub wall. In one embodiment, the first portion 27 of the front piece 10 comprises a top surface, which is conjoined with the middle portion 29. In one embodiment, the middle portion 29 comprised of a water-impermeable material. The middle portion 29 is configured to extend upward and downward to a plurality of pre-determined heights. The user could lift or extend upward, by handle 24 or not, at one of the middle portion or second portion 29 while the first portion 27 of the front piece 10 securely adheres to the top surface of the wall of the bathtub 22. The lifted or extended portion may remain in position with a hook 28. In one embodiment, the rectangular fitting or apparatus is configured to store or house water in the bathtub 22 to a level above the top edge of the wall of the bathtub 22, thereby converting the bathtub 22 into a soaking tub or a soaker. In one embodiment, the user could easily egress from the bathtub 22 by lowering and pushing the middle portion 29 of the front piece or the first fitting 10.

Figure 3A:
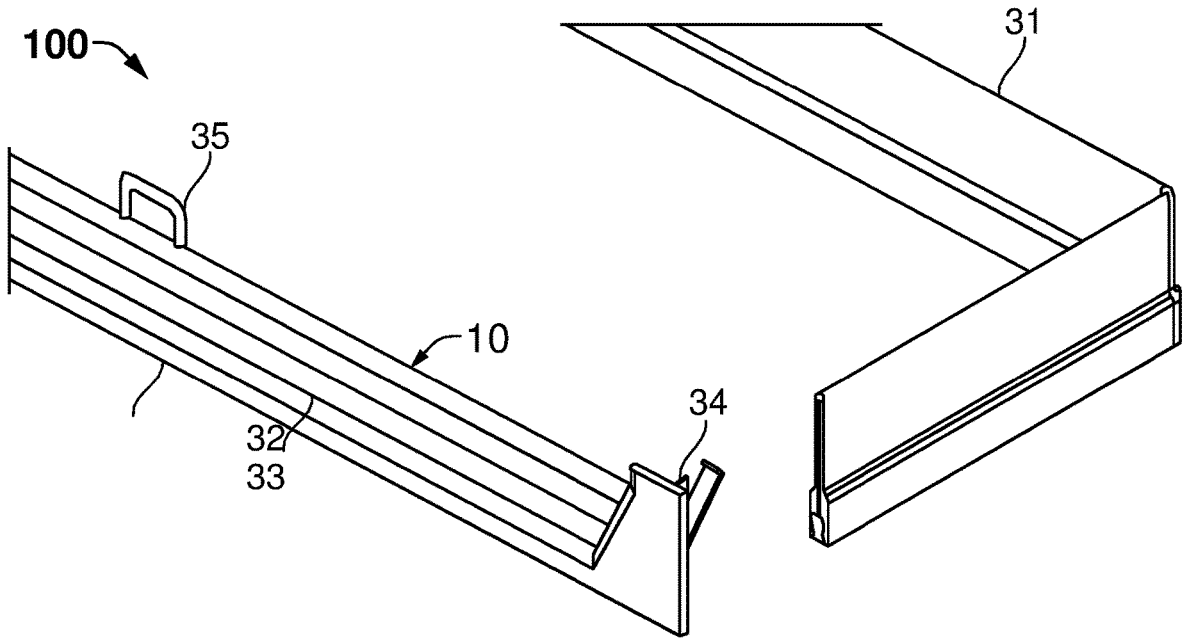
FIGS. 3A-3B exemplarily illustrate the front piece of the apparatus securely affixed to a second fitting or 3-piece back panel, according to one or more aspect of the present invention.
Figure 3B:
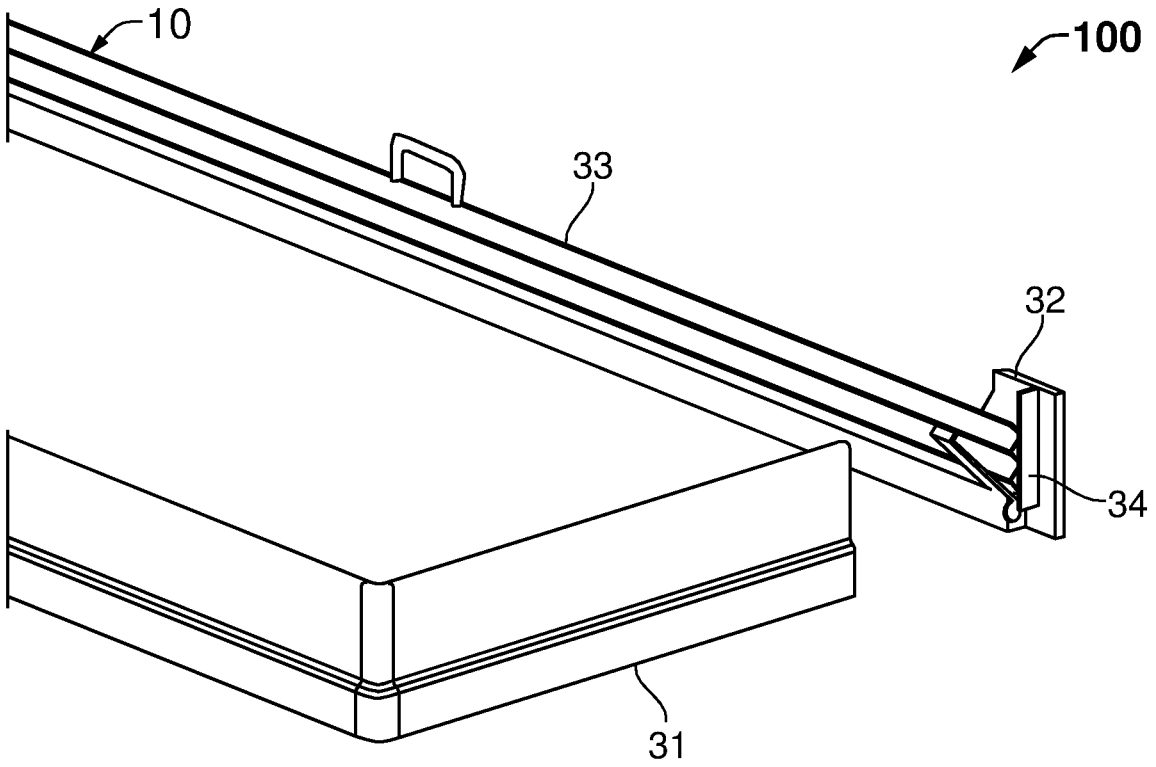

Referring to FIGS. 3A-3B, the first fitting or front piece 10 securely affixed to a second fitting or 3-piece back panel 31 is disclosed. In one embodiment, the first fitting 10 is securely affixed to the second fitting 31 using, but not limited to, a latch 34. In one embodiment, the second fitting or 3-piece back panel 31 is comprised of three-panels, which are affixed to form a U-shaped arrangement. In one embodiment, the second fitting 31 is conformed to both sides and a back-top edge of the wall of the bathtub 42 (shown in FIG. 4). In one embodiment, the second fitting 31 securely adheres to the top edge of the two sides and back wall of the bathtub 42. In one embodiment, the adhesive could be at least any one of, but not limited to, a rubber or a vinyl adhesive. In some embodiments, the second fitting 31 could not adhere to the top edge of the two sides and back wall of the bathtub 42. In one embodiment, the first portion 32 of the front piece 10 (1p/1f) adheres to the first or front top edge of the wall of the bathtub 42 in order to be dimensionally conformed and conjoined with the second fitting 31. In one embodiment, the middle portion 33 of the front piece 10 (mp/1f) is configured to enable the user to extend upward and downward to a plurality of pre-determined heights (optionally, by handle 35), while the first portion 32 of the front piece 10 securely adheres to the first or front top edge of the wall of the bathtub 42 in order to house or store water in the bathtub 42 to a level above the top edge of the wall, thereby converting the bathtub 42 into a soaking tub or a soaker. In some embodiments, the middle portion 33 of the front piece 10 is configured to enable the user to extend upward and downward to a pre-determined height and any user-preferred height.

Figure 4:
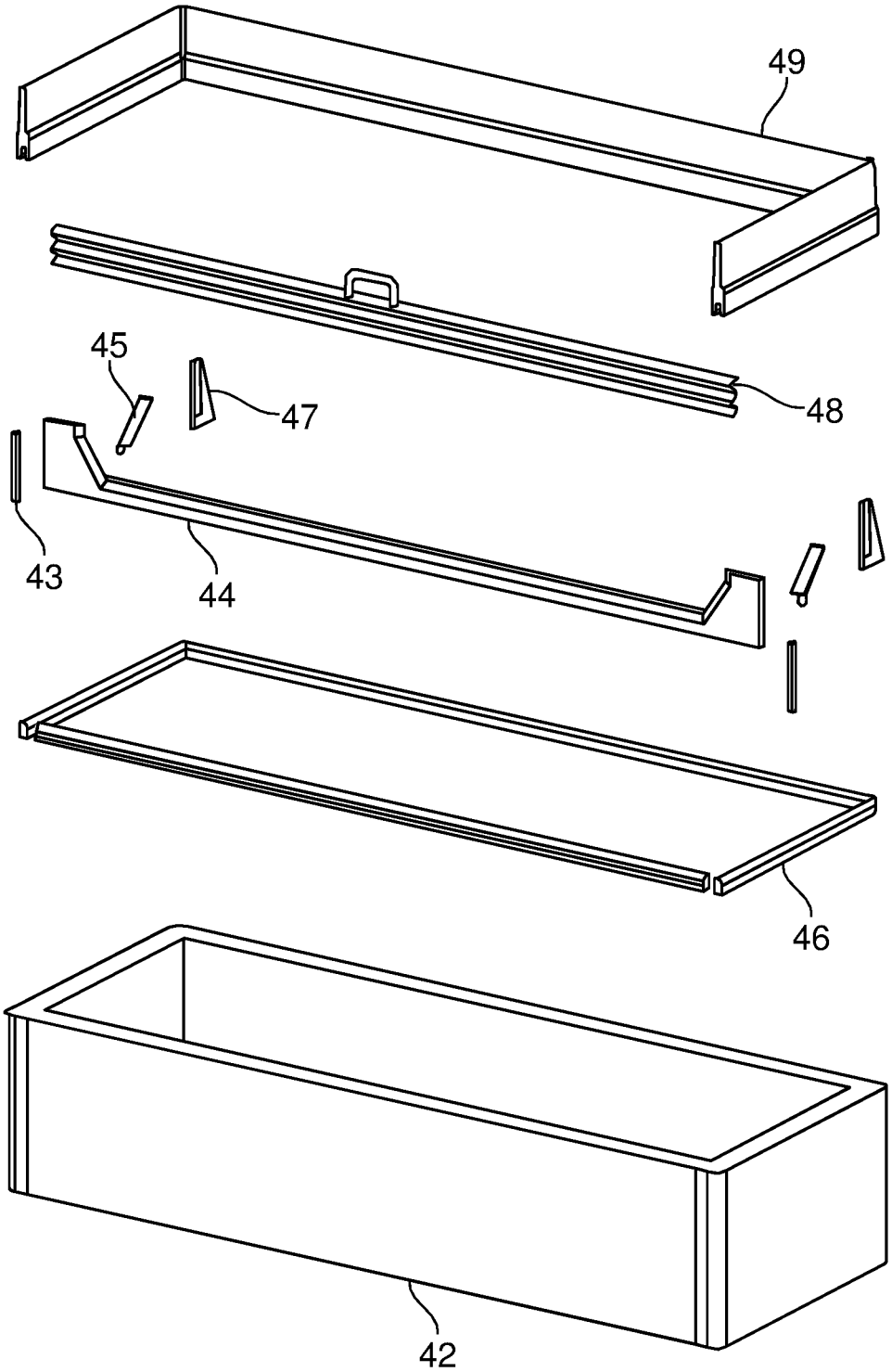
FIG. 4 exemplarily illustrates an assembly of the apparatus securely assembled and affixed to the top edge of the bathtub wall for converting a bathtub into a soaker, according to one or more aspect of the present invention.

Referring to FIG. 4, an assembly of the apparatus securely assembled and affixed over the top edge of the wall of the bathtub 42 for converting the bathtub 42 into a soaker is disclosed. In one embodiment, the first portion 44 of the front piece 10 (shown in FIG. 1A) is securely affixed to the front top edge of the wall of the bathtub 42 using an adhesive 43. In one embodiment, the middle portion 48 of the front piece 10 is securely positioned on the top surface of the first portion 44 of the front piece 10 using latches, corner fittings 47, and a pair of locks 45 on both sides. In one embodiment, the first portion 44 of the front piece 10 and the second fitting or 3-piece back panel 49 are securely affixed over the top edge of the wall of the bathtub 42 using a bracket 46, thereby converting the bathtub 42 into a soaker for storing or housing water to a plurality of pre-determined heights and/or above the top edge of the wall of the bathtub 42.

Figure 5:
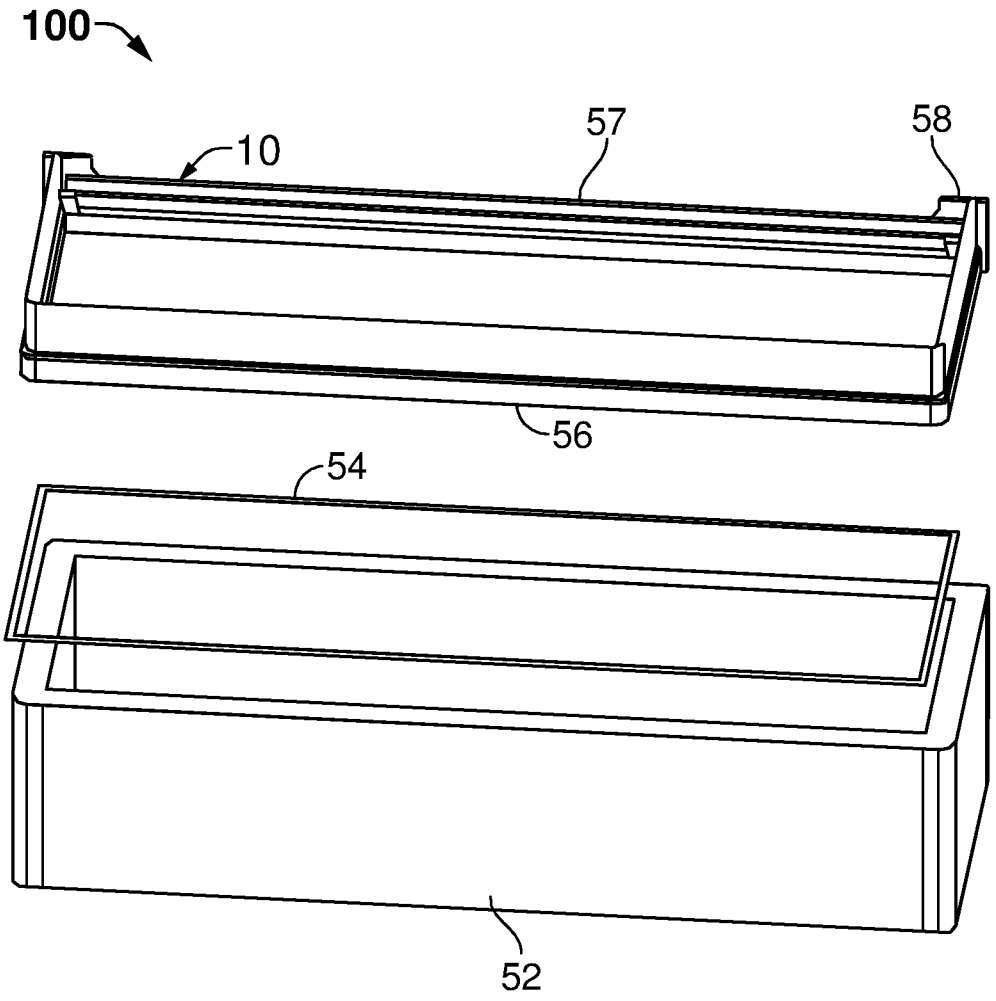
FIG. 5 exemplarily illustrates an assembly of a rectangular fitting of the apparatus securely affixed to the top edge of the bathtub wall using a bracket for converting a bathtub into a soaker, according to one or more aspect of the present invention.

Referring to FIG. 5, an assembly of the rectangular fitting securely affixed over the top edge of the wall of the bathtub 52 using a bracket 54 for converting into a soaker is disclosed. In one embodiment, the rectangular fitting includes a middle portion 57 of the first fitting/front piece 10, the first portion 58 of the front piece 10, and a second fitting or 3-piece back panel 56. In one embodiment, the rectangular fitting is securely affixed over the top edge of the wall of the bathtub 52 using a bracket 54 for converting the bathtub 52 into a soaker. In one embodiment, the bracket 54 securely adheres to the top edge of the wall of the bathtub 52. In one embodiment, the rectangular fitting could be securely adhered to the top edge of the wall of the bathtub 52 using the bracket 54 to store or house water to a plurality of pre-determined heights or above the bathtub wall by extending the middle portion 57 of the front piece 10 by the user, thereby converting the bathtub 52 into a soaking tub or a soaker.

Figure 6:
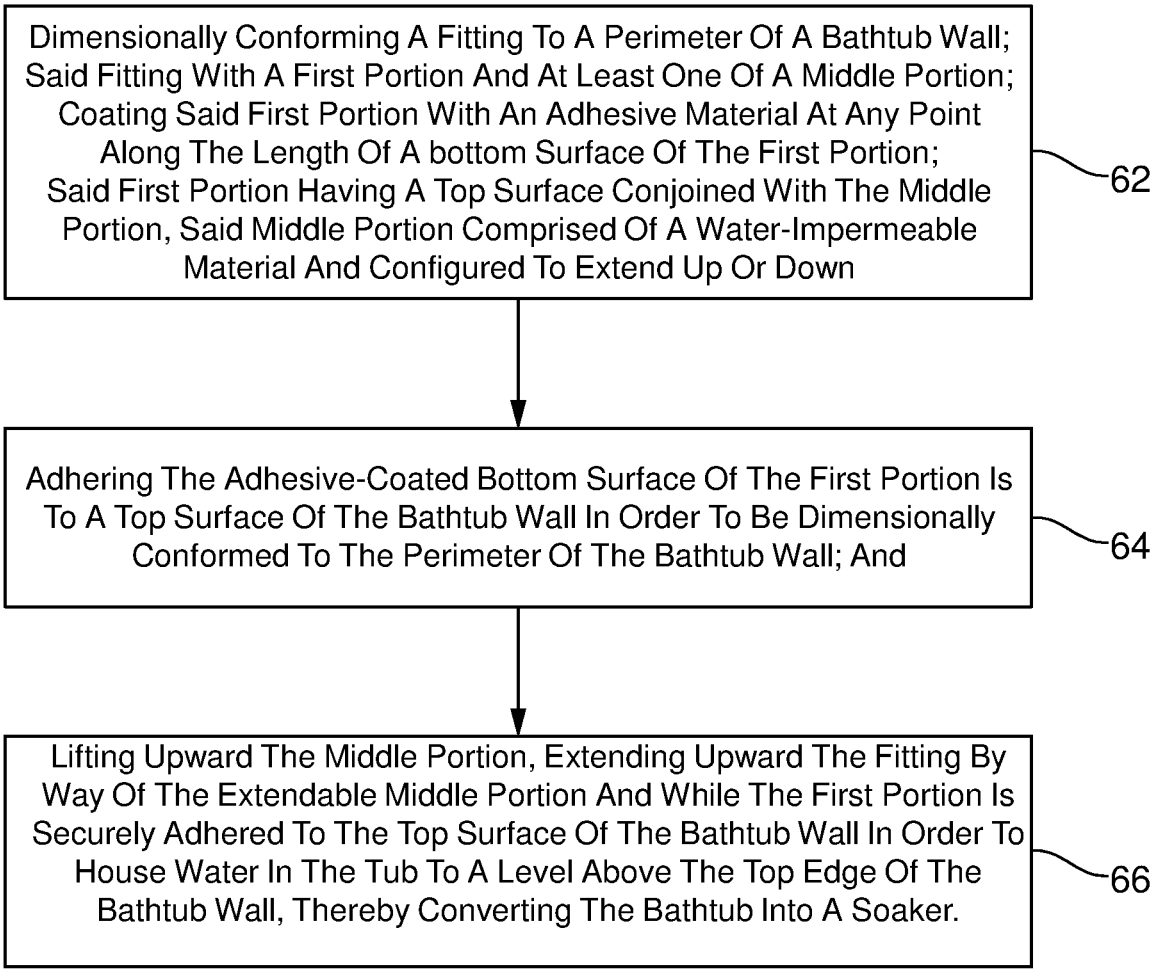
FIG. 6 a flow chart illustrates a method for converting the bathtub into a soaker, according to one or more aspect of the present invention.

Referring to FIG. 6, a method for converting the bathtub into a soaker is disclosed. At step 62, the fitting is dimensionally conformed to a perimeter of the bathtub wall. The fitting comprises a first portion 58 (shown in FIG. 5) and a middle portion 57 (shown in FIG. 5). The bottom surface of the first portion 58 is coated at any point along the length with an adhesive material. The first portion 58 having the top surface is conjoined with the middle portion 57 that comprised of a water-impermeable material. The middle portion 57 is configured to enable the user to extend upwards and downwards to a plurality of pre-determined heights. At step 64, the adhesive-coated bottom surface of the first portion 58 securely adheres to a top surface of the bathtub wall in order to be dimensionally conformed to the perimeter of the bathtub wall. Further, at step 66, the middle portion 57 is lifted upward to a pre-determined height while the first portion 58 (shown in FIG. 5) securely adheres to the top surface of the bathtub wall in order to store or house water in the bathtub 52 to a level above the top edge of the bathtub wall, thereby converting the bathtub 52 into a soaker.

Figure 7:
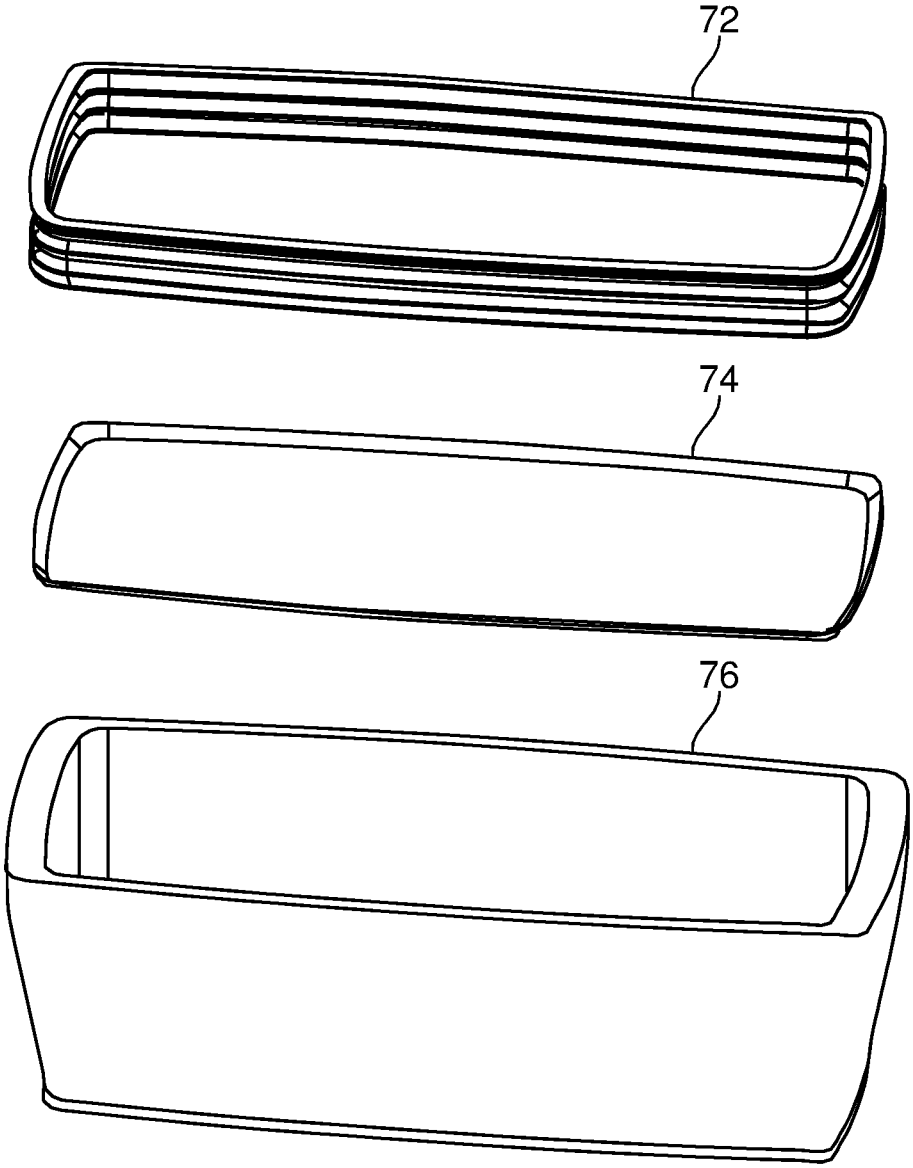
FIG. 7 exemplarily illustrates an assembly of the rectangular fitting securely affixed to the top edge of the bathtub wall using a bracket for converting a bathtub into a soaker, according to one or more aspect of the present invention.

Referring to FIG. 7, an assembly of the rectangular fitting 72 securely affixed to the top edge of the bathtub wall using a bracket 74 for converting a bathtub 76 into a soaker is disclosed. In another embodiment, the rectangular fitting 72 is securely affixed to the top edge of the bathtub wall using the bracket 74 for converting a bathtub 76 into a soaker. In one embodiment, the rectangular fitting 72 is dynamically conformed to a wall perimeter of the bathtub 76. In one embodiment, the rectangular fitting 72 could be, but not limited to, a rectangular fitting. In one embodiment, the rectangular fitting 72 is dynamically conformed to a first or front top edge of the bathtub's wall. In one embodiment, the rectangular fitting 72 comprises a first portion or a bracket 74 and a middle portion or a second portion. In one embodiment, the first portion 74 acts as a base for the rectangular fitting 72. In one embodiment, the first portion 74 is a non-pliable or non-flexible base. The first portion 74 is composed of at least one of a material include, but not limited to, a polyvinyl, a polyethylene, styrene, a polycarbonate, an acetal, an acrylic, and a polypropylene material. In one embodiment, the middle portion of the rectangular fitting 72 comprised of any one of a water-impermeable material. In one embodiment, the first portion 74 is coated with an adhesive material at any point along the length of a bottom surface of the first portion 74. The adhesive coated bottom surface of the first portion 74 is dimensionally adhered to the first or the front top edge of the wall of the bathtub 76. In one embodiment, the adhesive is at least one of, but not limited to, rubber and/or a vinyl adhesive.

In one embodiment, the first portion 74 has a top surface, which is conjoined with the middle portion of the rectangular fitting 72. The middle portion is configured to be extended up and retracted down from the top surface of the bathtub's wall to a pre-determined height, based on the user requirement. In one embodiment, the middle portion of the rectangular fitting 72 is in the form of, but not limited to, an accordion-pleated structure. The middle portion of the rectangular fitting 72 comprises a plurality of wrinkles or folds, which enables the rectangular fitting 72 to extend upwards and retract downwards to a plurality of pre-determined heights, based on the user requirement. In one embodiment, the user could lift the middle portions of rectangular fitting 72 for extending upward to a pre-defined height. In some embodiments, the user could lift the middle portions of the rectangular fitting 72 for extending upward to a plurality of pre-defined heights. In one embodiment, the user could lift any one of the middle portion of the rectangular fitting 72 to any user-preferred height.

In one embodiment, the user could lift the middle portion of the rectangular fitting 72 by extending upwards or retracting downwards, while the first portion 74 securely adheres to the top edge of the bathtub's wall in order to house water in the bathtub 76 to a level above the top edge of the bathtub wall, thereby converting the bathtub 76 into the soaking tub or the soaker. In one embodiment, the user could easily egress from the bathtub 76 by lowering the middle portion of the rectangular fitting 72. In some embodiments, the user could easily egress from the bathtub 76 by lifting upwards the middle portion of the rectangular fitting 72 from the first portion 74 and/or removing the middle portion of the rectangular fitting 72. In one embodiment, the middle portion of the rectangular fitting 72 is a pliable or flexible portion. The middle portion of the rectangular fitting 72 could be composed of at least any one of a material include, but not limited to, a polypropylene, a polyethylene, a flexible plastic sheet, a vinyl, and a rubber.

Figure 8:
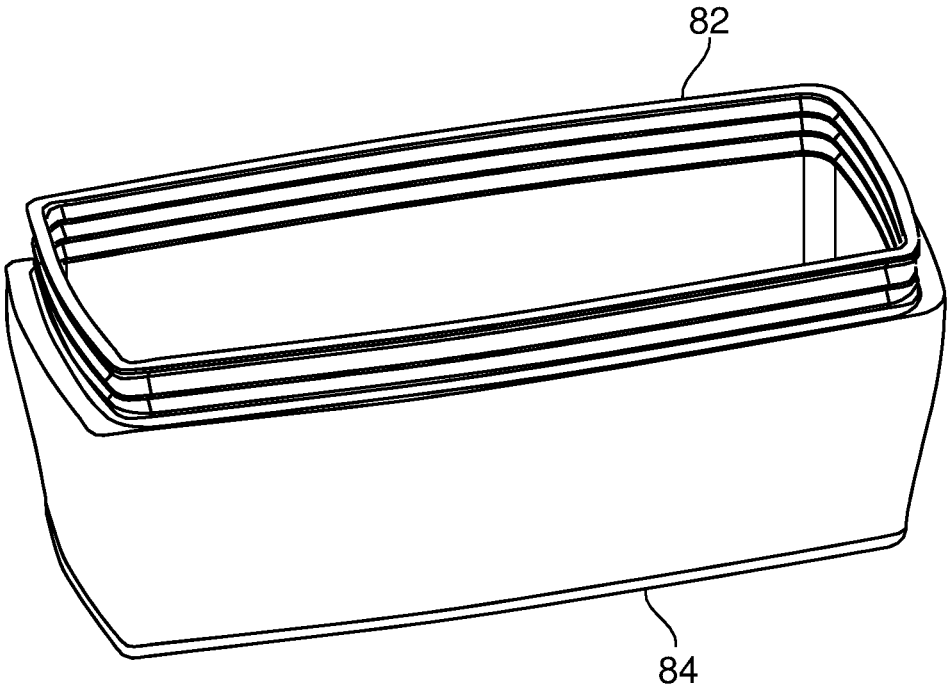
FIG. 8 exemplarily illustrated a rectangular fitting adhesively secured to the top edge of the bathtub wall for converting a bathtub into a soaker, according to one or more aspect of the present invention.

Referring to FIG. 8, a rectangular fitting 82 adhesively secured to the top edge of the bathtub wall for converting a bathtub 84 into a soaker is disclosed. In another embodiment, the rectangular fitting 82 is simply and adhesively secured to the top edge of the bathtub wall for converting a bathtub 84 into a soaker. In embodiment, the rectangular fitting 82 is configured to enable a user to extend upward or downward to a plurality of pre-determined heights. The rectangular fitting 82 is in the form of, but not limited to, an accordion-pleated structure. In one embodiment, the rectangular fitting 82 comprises a plurality of wrinkles or folds. In one embodiment, the rectangular fitting 82 is dimensionally conformed to a perimeter of the wall of the bathtub 84. The rectangular fitting 82 is comprised of any one of a water-impermeable material. In one embodiment, the rectangular fitting 82 is configured to be extendable in an upward direction and retractable in a downward direction by the user. In one embodiment, the rectangular fitting 82 is coated with an adhesive material at any point along the length of its bottom surface. In one embodiment, the adhesive-coated bottom edge of the rectangular fitting 82 adheres to a top edge of the wall of the bathtub 84 in order to dimensionally conformed to the perimeter of the wall. The user could lift the rectangular fitting 82 in the upward direction, while the rectangular fitting 82 securely adheres to the top edge of the wall of the bathtub 84. In one embodiment, the rectangular fitting 82 is securely adhered to the top edge of the wall of the bathtub 84 in order to house or store water to the desired level above the top edge of the bathtub's wall, thereby converting the bathtub 84 into the soaking tub or a soaker.

Figure 9:
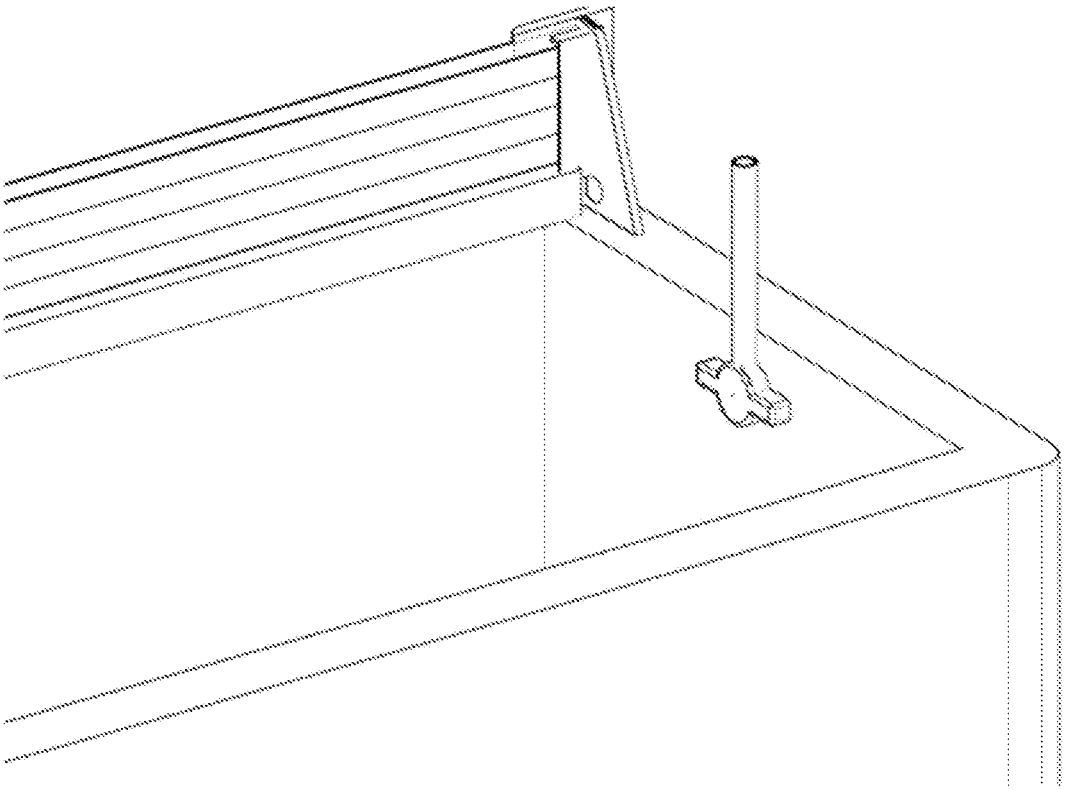
FIG. 9 exemplifies an embodiment of the present invention.

Now in reference to FIG. 9. In a preferred embodiment, regardless of any of the various configurations—as described above, claimed, and illustrated in any of FIGS. 1-8—an overflow stopper may be provided, wherein a rubberized stopper is dimensioned to fit within the overflow valve that is customary on most standard tubs as a way to allow the water level to surpass the point of the overflow valve. The overflow valve is intended to drain water from a filling tub that is about to reach a certain level dangerously close to overflowing over the tub. By inserting this stopper, the water level may surpass this demarcated point and allow the tub to convert into the soaker as described, claimed, and illustrated in the present claimed invention. The stopper may be configured in any number of ways to accomplish drainage prevention of the overflow valve. In one configuration, it may be a suction-type cup that caps and forms a seal over the drainage. In another embodiment, it may be an insert that completely forms a clog over the drainage. In other embodiments, the stopper may have an elongated tube in an upright position slightly shorter than the height of the fitting walls as a way to allow overflow water to drain back into the drainage and allow the filling tub to only fill to a certain level, slightly below the height of the fitting to prevent overflow of the fitting. In other embodiments, the stopper may have a lever that allows a user to flip up or down the lever as a way to start draining the tub to a lower level, yet higher or at level with the overflow drain.

Although a single embodiment of the invention has been illustrated in the accompanying drawings and described in the above detailed description, it will be understood that the invention is not limited to the embodiment developed herein, but is capable of numerous rearrangements, modifications, substitutions of parts and elements without departing from the spirit and scope of the invention.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. An apparatus for converting a bathtub into a soaker, said apparatus comprising:

a rectangular fitting dimensionally conformed to a perimeter of a bathtub wall;

said fitting with a first portion and a middle portion;

said first portion comprised of any one of a water-impermeable material coated with an adhesive material at any point along the length of a bottom surface of the first portion;

said first portion having a top surface conjoined with the middle portion, said middle portion comprised of a water-impermeable material and configured to extend up or down;

wherein a user lifts upward the middle portion, extending upward the fitting by way of the extendable middle portion and while the first portion is securely adhered to the top surface of the bathtub wall; and an overflow drain stopper with an upright elongated and hollow member to be inserted into a tub overflow drain to elevate an overflow drain level above the tub overflow drain and below a top edge of the upwardly extended middle portion in order to house water in the tub to a level above the tub overflow drain, thereby converting the bathtub into a soaker.

2. The apparatus of claim 1, wherein the first portion is non-pliable base and composed of at least one of a polyvinyl, polyethylene, styrene, polycarbonate, acetal, acrylic, or polypropylene material.

3. The apparatus of claim 1, wherein the middle portion is pliable and composed of at least one of a polypropylene, polyethylene, flexible plastic sheet, vinyl, or rubber.

4. The apparatus of claim 1, wherein the adhesive is at least one of a rubber or vinyl adhesive.

5. The apparatus of claim 1, wherein lifting upward the middle portion to a pre-defined height.

6. The apparatus of claim 1, wherein lifting upward the middle portion to a plurality of pre-defined heights.

7. The apparatus of claim 1, wherein lifting upward the middle portion to any user-preferred height.

8. An apparatus for converting a bathtub into a soaker, said apparatus comprising:

a rectangular fitting dimensionally conformed to a perimeter of a bathtub wall, said fitting comprised of any one of a water-impermeable material and configured to extend up and down, wherein the fitting is coated with an adhesive material at any point along the length of a bottom surface of the fitting;

wherein the adhesive-coated bottom surface of the fitting is adhered to a top surface of the bathtub wall in order to be dimensionally conformed to the perimeter of the bathtub wall;

wherein a user lifts upward the fitting, extending upward the fitting, while the fitting is securely adhered to the top surface of the bathtub wall; and an overflow drain stopper with an upright elongated and hollow member to be inserted into a tub overflow drain to elevate an overflow drain level above the tub overflow drain and below a top edge of the upwardly extended middle portion in order to house water in the tub to a level above the tub overflow drain, thereby converting the bathtub into a soaker.

9. An apparatus for converting a bathtub into a soaker, said apparatus comprising:

a fitting dimensionally conformed to a first or front top edge of a bathtub wall;

said fitting with a first portion and a middle portion;

said first portion comprised of any one of a water-impermeable material coated with an adhesive material at any point along the length of a bottom surface of the first portion;

said first portion having a top surface conjoined with the middle portion, said middle portion comprised of a water-impermeable material and configured to at least one of extend up, down, or be removed;

wherein the adhesive-coated bottom surface of the first portion is adhered to the first or front top edge of the bathtub wall in order to be dimensionally conformed;

wherein a user lifts upward the middle portion of the fitting, extending upward or removing the middle portion by way of the middle portion and while the first portion is securely adhered to the first or front top edge of the bathtub wall; and an overflow drain stopper with an upright elongated and hollow member to be inserted into a tub overflow drain to elevate an overflow drain level above the tub overflow drain and below a top edge of the upwardly extended middle portion in order to house water in the tub to a level above the tub overflow drain, thereby converting the bathtub into a soaker.

10. The apparatus of claim 9, wherein the first portion is a non-pliable base and composed of at least one of a polyvinyl, polyethylene, styrene, polycarbonate, acetal, acrylic, or polypropylene material.

11. The apparatus of claim 9, wherein the middle portion is pliable and composed of at least one of a polypropylene, polyethylene, flexible plastic sheet, vinyl, or rubber.

12. The apparatus of claim 9, wherein the adhesive is at least one of a rubber or vinyl adhesive.

13. The apparatus of claim 9, wherein lifting upward the middle portion to a pre-defined height.

14. The apparatus of claim 9, wherein lifting upward the middle portion to a plurality of pre-defined heights.

15. The apparatus of claim 9, wherein lifting upward the middle portion to any user-preferred height.

16. An apparatus for converting a bathtub into a soaker comprising:

an upwardly extending bathtub fitting; and an overflow drain stopper with an upright elongated and hollow member to be inserted into an overflow drain of a tub to elevate an overflow drain level above the tub overflow drain and below a top edge of the upwardly extended bathtub fitting in order to house water in the tub to a level above the tub overflow drain, thereby converting the bathtub into a soaker.

17. An apparatus for converting a bathtub into a soaker comprising:

an overflow drain stopper with an upright elongated and hollow member to be inserted into an overflow drain of a tub to elevate an overflow drain level above the tub overflow drain and below a top edge of an upwardly extended bathtub fitting in order to house water in the tub to a level above the tub overflow drain, thereby converting the bathtub into a soaker.

18. A bathtub-soaker convertible apparatus for convenient ingress and egress for a user in bathtub soaking, said apparatus comprising:

A bathtub fitting conformed and adhered to a top surface of walls of a bathtub, said bathtub fitting configured to rest at level with the top surface of the bathtub walls during user bathtub ingress;

said bathtub fitting to extend above the top surface of the bathtub walls, converting the bathtub into a soaker during user bathtub soaking; and lower down said bathtub fitting to the rest level during user bathtub egress.

* * * * *